US009675112B2

(12) United States Patent
Liu

(10) Patent No.: US 9,675,112 B2
(45) Date of Patent: Jun. 13, 2017

(54) SOFT ELECTRONIC CIGARETTE

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 835 days.

(21) Appl. No.: 14/041,972

(22) Filed: Sep. 30, 2013

(65) Prior Publication Data

US 2015/0013692 A1 Jan. 15, 2015

(30) Foreign Application Priority Data

Jul. 11, 2013 (CN) ..... 2013 2 0414120 U

(51) Int. Cl.
*A24F 47/00* (2006.01)

(52) U.S. Cl.
CPC ..... *A24F 47/008* (2013.01)

(58) Field of Classification Search
CPC ..... A24F 47/008; A61M 15/06
See application file for complete search history.

(56) References Cited

U.S. PATENT DOCUMENTS

2005/0016553 A1* 1/2005 Iannuzzi ..... A24F 47/002 131/273
2011/0303231 A1* 12/2011 Li ..... A24F 47/008 131/329
2013/0213418 A1* 8/2013 Tucker ..... A24F 47/008 131/328
2013/0247924 A1* 9/2013 Scatterday ..... A61M 15/06 131/329

* cited by examiner

*Primary Examiner* — Cynthia Szewczyk
(74) *Attorney, Agent, or Firm* — Tim Tingkang Xia, Esq.; Locke Lord LLP

(57) ABSTRACT

This present invention relates to a soft electronic cigarette comprising an atomization component, a power component, and an outer sleeve configured for accommodating at least one of the atomization component and the power component; an outer side of one end of the outer sleeve is coaxially mounted with a filter tip structure, and the filter tip structure includes a cylindrical flexible body and a first sticker coated on an outer surface of the flexible body. The soft electronic cigarette in a mouth has the same feeling as a filter tip of a cigarette. The soft electronic cigarette can completely meet psychological and physiological needs of smokers, enhance user experience, and be beneficial for improving the effects of quitting smoking. In production, it is convenient for assembly and disassembly, an operation of the production is made to be simple, and the production efficiency is improved.

13 Claims, 5 Drawing Sheets

SOFT ELECTRONIC CIGARETTE

CROSS-REFERENCE TO RELATED APPLICATIONS

This non-provisional application claims priority under 35 U.S.C. §119(a) on Patent Application No. 201320414120.7 filed in P.R. China on Jul. 11, 2013, the entire contents of which are hereby incorporated by reference.

FIELD OF THE INVENTION

This present invention relates to the field of electronic products, and more particularly to a soft electronic cigarette.

BACKGROUND OF THE INVENTION

An electronic cigarette is a new electronic product. Electronic cigarettes have the same appearances as cigarettes, so they are often used in nicotine replacement therapies to help smokers to quit smoking. Thus, electronic cigarettes are more and more widely used.

A typical electronic cigarette generally comprises an outer sleeve, and the outer sleeve accommodates an atomization component, a power component, and so on. The typical electronic cigarette further includes a simulated filter tip component received in the outer sleeve. In general, this type of filter tip is not soft and doesn't conform to the feeling of smokers that cigarettes are put in their mouths for years, and the smokers may usually generate psychological resistance. Therefore, the typical electronic cigarette cannot completely meet psychological and physiological needs of smokers and has poor user experience, which affects quitting smoking effect directly. Additionally, in automatic production, the filter tip component needs to be inserted into the outer sleeve, which is difficult to operate and is inconvenient to automatically produce the electronic cigarette using machines.

SUMMARY OF THE INVENTION

The object of the present invention is to provide a soft electronic cigarette to solve the problem that the aforementioned filter tip of the typical electronic cigarette is not soft and the production of which is difficult to operate.

In order to realize the object mentioned above, a soft electronic cigarette is provided, comprising an atomization component, a power component, and an outer sleeve configured for accommodating at least one of the atomization component and the power component; an outer side of one end of the outer sleeve is coaxially mouted with a filter tip structure, and the filter tip structure includes a cylindrical flexible body and a first sticker coated on an outer surface of the flexible body.

The atomization component is received in the outer sleeve, and an end surface of the flexible body and an end surface of the atomization component contact each other to form a radial coplanar structure.

The first sticker further envelops the outer sleeve.

An adhesive layer is formed on an inner surface of the first sticker.

An outer surface of the outer sleeve is coated with a second sticker.

The second sticker further envelops the first sticker.

The second sticker includes a first surface and a second surface that are opposite to each other, the first surface is a smooth surface configured to face and be adhered to both the outer surface of the outer sleeve and the outer surface of the filter tip structure when the second sticker is winded, and the second surface is provided with a concave and convex type design and/or text.

The first sticker and the second sticker partially overlap each other, and the first sticker is coated outside the second sticker.

A flexible layer formed by soft rubber or filler is disposed between the outer sleeve and the second sticker.

An outer surface of the outer sleeve and an outer surface of the filter tip structure are coaxially coated with a third sticker, the third sticker is configured to fixedly connect the filter tip structure with the outer sleeve, and the second sticker is disposed between the outer sleeve and the third sticker.

The third sticker includes a third surface and a fourth surface that are opposite to each other, the third surface is a smooth surface configured to face and be adhered to both the outer surface of the second sticker and the outer surface of the filter tip structure when the third sticker is winded, and the fourth surface is provided with a concave and convex type design and/or text.

The flexible body is a fiber filter cotton flexible body or a non-woven filter cotton flexible body.

The filler forming the flexible layer is at least one of carbon particle, plastic particle, glass particle, wooden particle, and metal particle, and is configured to simulate cut tobacco.

The first sticker is any one of tipping paper, art paper, plastic paper, and synthetic paper.

The second sticker is any one of tipping paper, art paper, plastic paper, and synthetic paper.

The third sticker is any one of tipping paper, art paper, plastic paper, and synthetic paper.

The flexible body is stuck to or fused with one end of the atomization component or one end of the power component When smokers use the soft electronic cigarette of this invention which comprises a filter tip structure including a flexible body and a sticker coated on an outer surface of the flexible body, the filter tip structure in a mouth has the same feeling as a filter tip of a cigarette. Thus, the soft electronic cigarette can completely meet psychological and physiological needs of smokers, enhance user experience, and be beneficial for improving the effects of quitting smoking. Moreover, in production, by means that the filter tip structure is directly connected to the outer sleeve, it is convenient for assembly and disassembly, an operation of the production is made to be simple, and the production efficiency is improved.

DETAILED DESCRIPTION OF THE PREFERRED EMBODIMENT

Figure 1:
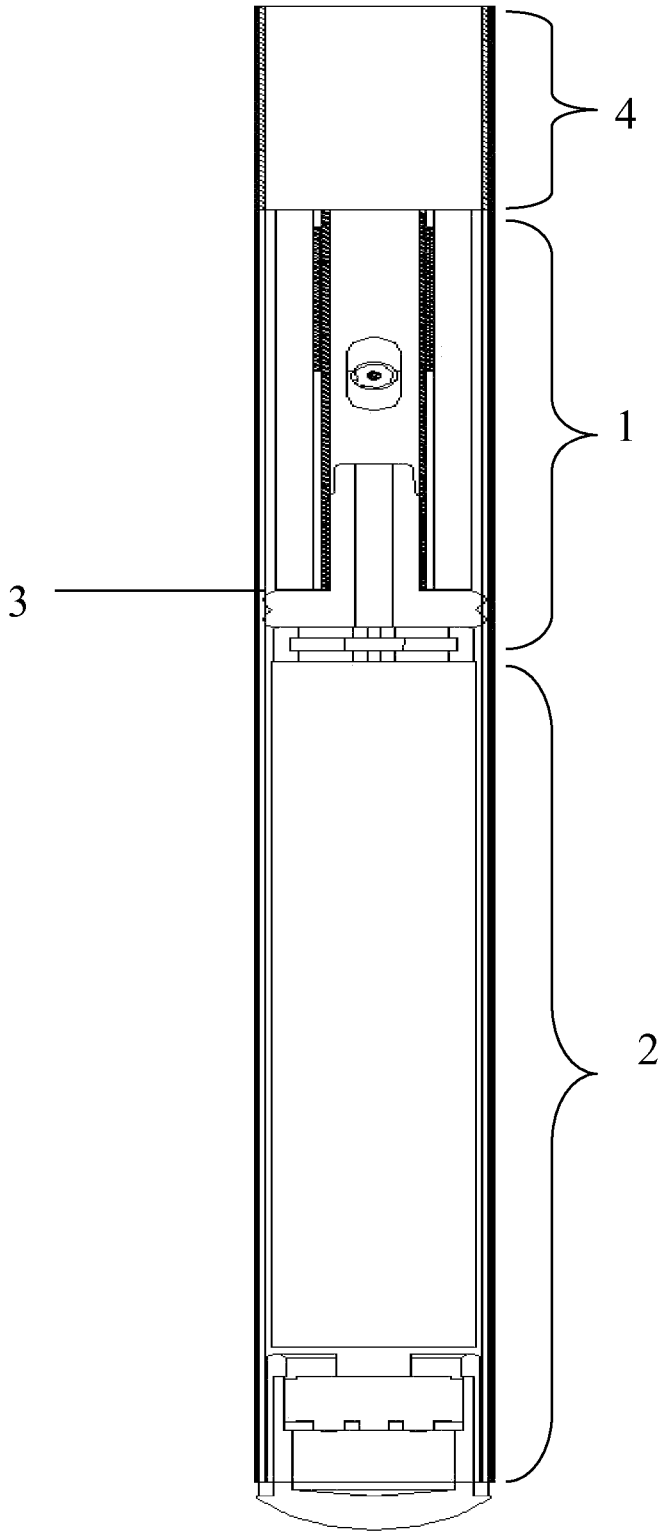
FIG. 1 is a schematic cut-away view of a soft electronic cigarette of a first embodiment of the present invention.

In order to understand the technical features, the purpose and the effect of the present invention more clearly, the specific embodiments of the present invention will be described referring to the drawings.

Figure 2:
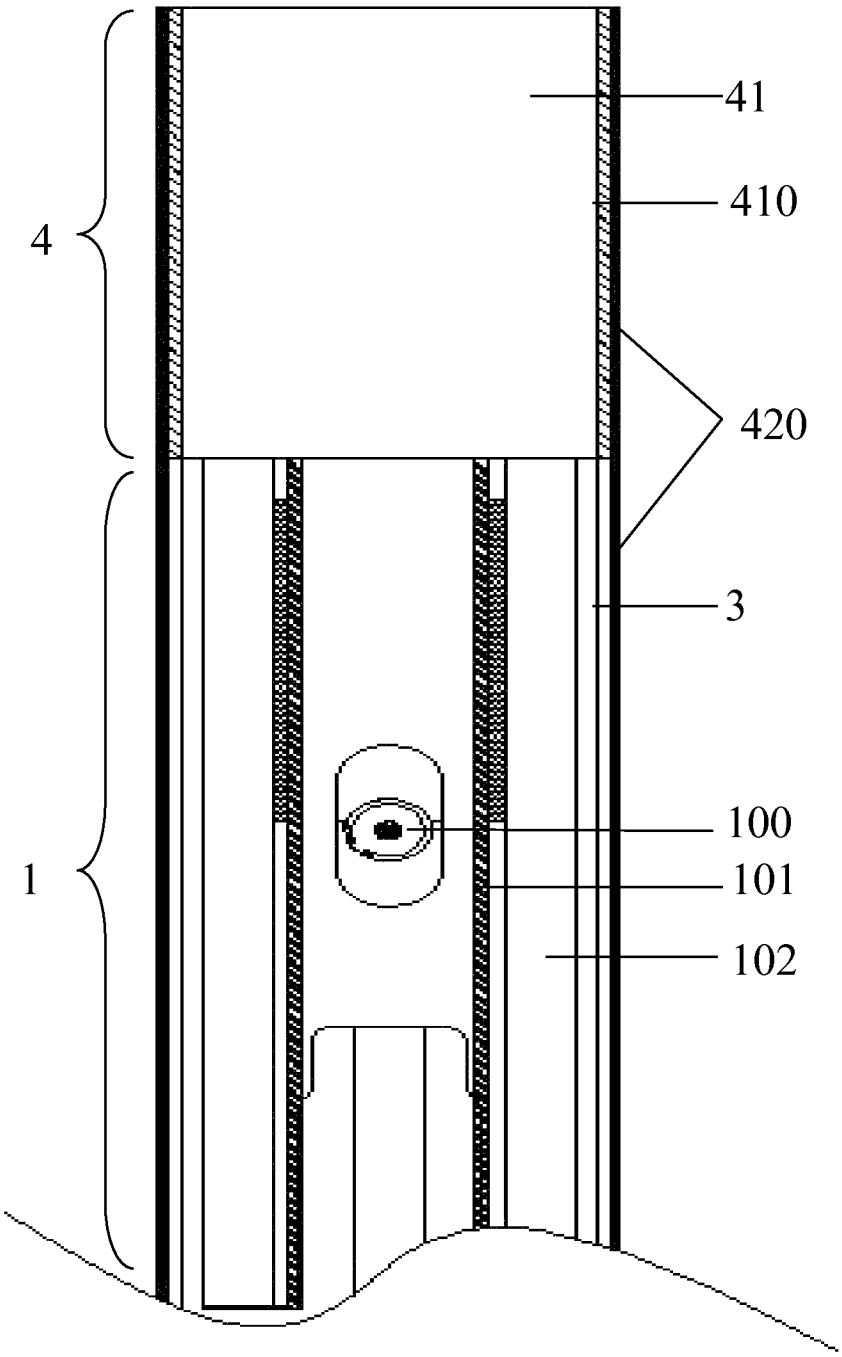
FIG. 2 is a partial schematic view of a soft electronic cigarette of a second embodiment of the present invention.

Referring to FIG. 1, a soft electronic cigarette comprises an atomization component 1 and a power component 2. Referring to FIG. 2, the atomization component 1 includes a heating wire 100, a Huang Na pipe 101, and an oil storage cotton 102. It is understandable that the atomization component 1 can be an ultrasonic atomization. The atomization component 1 can further include an independent oil cup, and so on. The power component 2 includes a battery or a high-energy electric capacity, and so on.

Referring to FIG. 1 and FIG. 2, the soft electronic cigarette further comprises an outer sleeve 3 and a filter tip structure 4 coaxially mounted on an outer surface of one end of the outer sleeve 3. The connecting way that the end of the outer sleeve 3 is directly connected with the filter tip structure 4 is convenient for assembly and disassembly, makes the production be simple, and greatly improves the production efficiency. Especially, these effects are particularly obvious in the automatic production aspect.

The outer sleeve 3 is sleeved outside both the atomization component 1 and the power component 2, and also can be only sleeved outside the atomization component 1. Correspondingly, the filter tip structure 4 is coaxially mounted on both one end of the atomization component 1 and one end of the outer sleeve 3 that are positioned at a same side.

Figure 3:
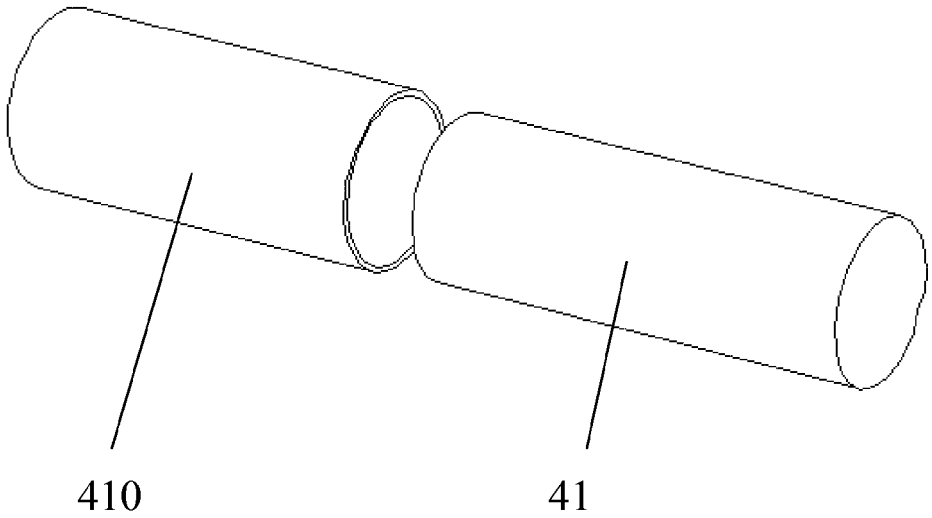
FIG. 3 is an exploded structural view of a filter tip structure of the electronic soft cigarette of the present invention.

Referring to FIG. 3, the filter tip structure 4 includes a cylindrical flexible body 41 and a first sticker 410 coated on an outer surface of the flexible body 41. The flexible body 41 can be a fiber filter cotton flexible body, a non-woven filter cotton flexible body, a breathable foam flexible body, and so on. The filter tip structure 4 has the same feeling in mouth as a cigarette filter tip, and it can completely meet psychological and physiological needs of smokers. Thus, it is beneficial to improve the effect of quitting smoking and enhance the users' experience. The first sticker 410 is winded, an adhesive layer is formed on an inner surface of the first sticker 410, and the adhesive layer is configured to stick the first sticker 410 to the flexible body 41. The first sticker 410 is any one of tipping paper, art paper, plastic paper, and synthetic paper.

Preferably, referring to FIG. 2, when the flexible body 41 is butt jointed with the atomization component 1, an end surface of the flexible body 41 and an end surface of the atomization component 1 contacting each other are completely aligned with each other and thereby form a radial coplanar structure. That is, the flexible body 41 is coaxial with all of the Huang Na pipe 101, the oil storage cotton 102, and a vent hole of the atomization component 1, and the butt jointed surfaces of these components are positioned in a same plane to form a radial coplanar structure. Thus, the soft electronic cigarette can achieve the best smoking effect.

It is understandable that the outer sleeve 3 can also be only sleeved outside the power component 2. Correspondingly, the filter tip structure 4 is coaxially mounted on both one end of the power component 2 and one end of the outer sleeve 3 that are positioned at a same side, and the atomization component 1 is mounted at the other end of the power component 2.

Furthermore, the outer sleeve 3 is fixedly connected with the filter tip structure 4 through different stickers, or the flexible body 41 is stuck to or fused with one end of the atomization component 1 or one end of the power component 2. Thus, the soft electronic cigarette held in a hand or held in a mouth has a feeling similar to a cigarette, which conforms to the habits of smokers. In this way, psychological and physiological needs of smokers can be met, the users' experience can be enhanced, and the effect of quitting smoking can be improved. Four specific embodiments are described in detail below.

Embodiment 1

The first sticker 410 further envelops the outer sleeve 3 (not labeled in the drawings), wherein, the first sticker 410 can partially or wholly envelop the outer sleeve 3. The first sticker 410 is winded, and an adhesive layer is formed on an inner surface of the first sticker 410. The adhesive layer is used to stick the first sticker 410 to both the flexible body 41 and the outer sleeve 3, so that the outer sleeve 3 and the filter tip structure 4 are connected with each other fixedly, and the feeling of the soft electronic cigarette in a hand can be improved.

Furthermore, the first sticker 410 is any one of tipping paper, art paper, plastic paper, and synthetic paper.

Embodiment 2

An outer surface of the outer sleeve 3 is coated with a second sticker 420, and the second sticker 420 further envelops the first sticker 410. The second sticker 420 can wholly envelop the first sticker 410 as shown in FIG. 2, and can also partially envelop the first sticker 410 (not labeled in the drawings). Thus, the outer sleeve 3 and the filter tip structure 4 are connected with each other fixedly, and the feeling of the soft electronic cigarette in a hand is improved.

Furthermore, a flexible layer (not labeled in the drawings) formed by soft rubber or filler is disposed between the outer sleeve 3 and the second sticker 420. The filler is at least one of carbon particle, plastic particle, glass particle, wooden particle, and metal particle, and is configured to simulate cut tobacco. In this way, the feeling of the soft electronic cigarette in a hand can be further improved, and is more like the feeling of a real cigarette held in a hand.

Furthermore, the second sticker 420 includes a first surface and a second surface that are opposite to each other, the first surface is a smooth surface configured to face and be adhered to both the outer surface of the outer sleeve 3 and the outer surface of the filter tip structure 4 when the first surface is winded, and the second surface is provided with a concave and convex type design and/or text which can increase the aesthetics.

Furthermore, the second sticker 420 is any one of tipping paper, art paper, plastic paper, and synthetic paper.

Embodiment 3

Figure 4:
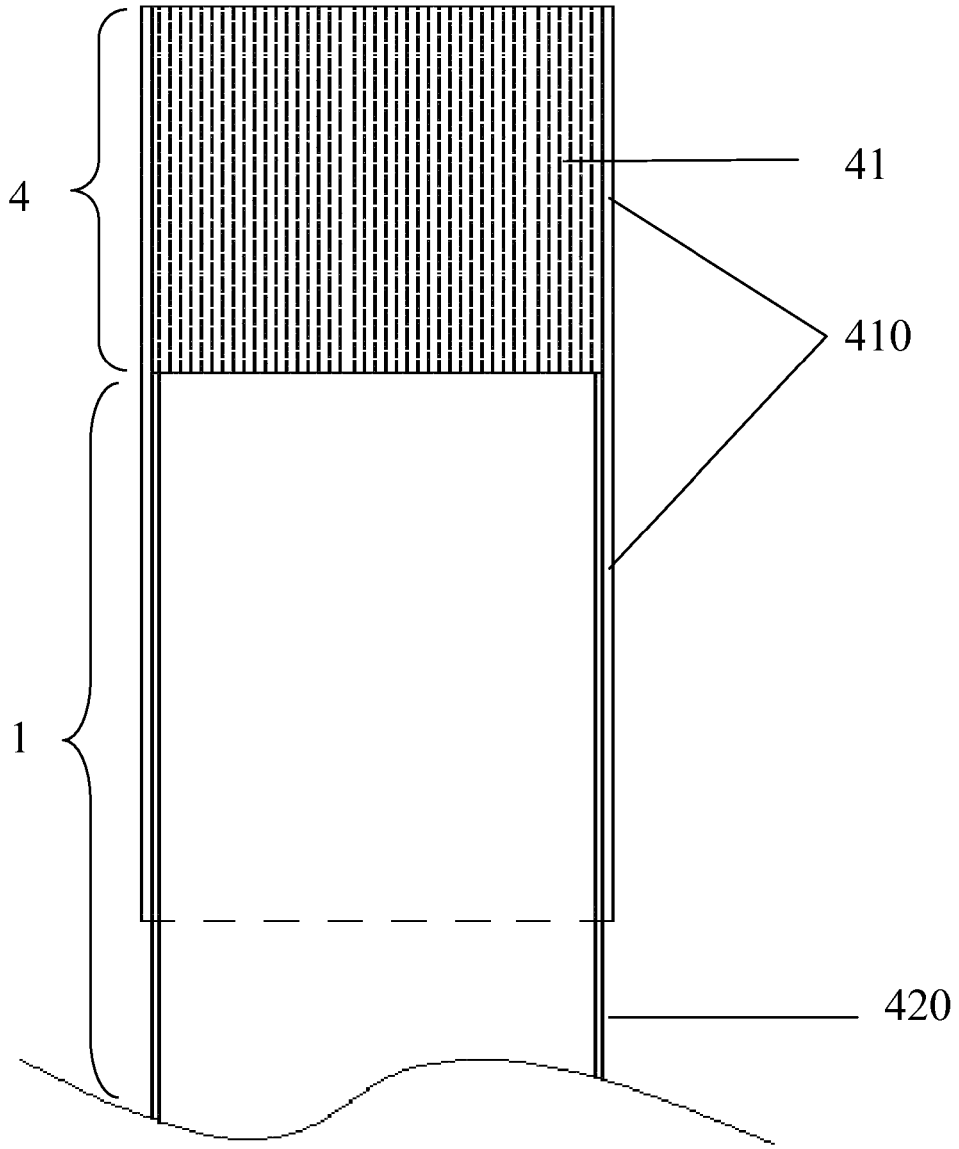
FIG. 4 is a partial schematic view of a soft electronic cigarette of a third embodiment of the present invention.

As shown in FIG. 4, the outer surface of the outer sleeve 3 is coated with a second sticker 420. The first sticker 410 and the second sticker 420 partially overlap each other, and the first sticker 410 envelops the second sticker 420. Thus, the outer sleeve 3 and the filter tip structure 4 are fixedly connected together, and the feeling of the soft electronic cigarette held in a hand is improved.

Furthermore, the flexible layer (not labeled in the drawings) formed by the soft rubber or filler is disposed between the outer sleeve 3 and the second sticker 420. The filler is at least one of carbon particle, plastic particle, glass particle, wooden particle, and metal particle, and is configured to simulate cut tobacco. Then the feeling of the soft electronic cigarette held in a hand can be further improved, and is more like the feeling of a real cigarette held in a hand.

Furthermore, the second sticker 420 is any one of tipping paper, art paper, plastic paper, and synthetic paper.

Embodiment 4

The outer surface of the outer sleeve 3 is coated with a second sticker 420, and both the outer surface of the outer sleeve 3 and the outer surface of the filter tip structure 4 are coaxially coated with a third sticker 430. The second sticker 420 is disposed between the outer sleeve 3 and the third sticker 430.

Figure 5:
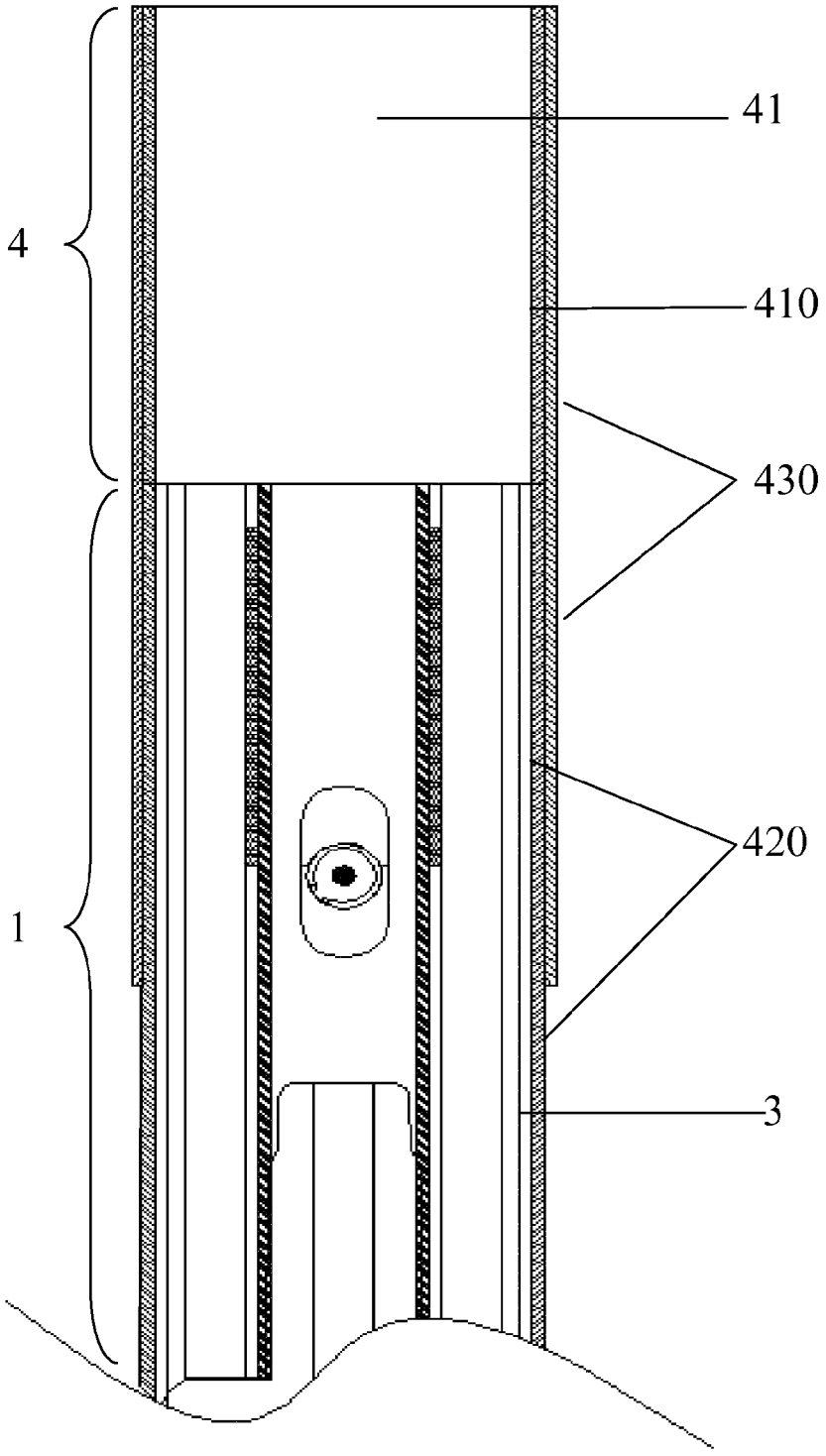
FIG. 5 is a partial schematic view of a soft electronic cigarette of a fourth embodiment of the present invention.

It is understandable that the third sticker 430 can envelop the whole outer surface of the filter tip structure 4 and a part of the outer surface of the outer sleeve 3, as shown in FIG. 5, or envelop a part of the outer surface of the filter tip structure 4 and the whole outer surface of the outer sleeve 3 (not labeled in the drawings), or envelop both the whole outer surface of the filter tip structure 4 and the whole outer surface of the outer sleeve 3 (not labeled in the drawings), or envelop both a part of the outer surface of the filter tip structure 4 and a part of the outer surface of the outer sleeve 3 (not labeled in the drawings). Thus, the filter tip structure 4 and the outer sleeve 3 are fixedly connected together, and the second sticker 420 is disposed between the outer sleeve 3 and the third sticker 430.

Furthermore, the third sticker 430 includes a third surface and a fourth surface that are opposite to each other, the third surface is a smooth surface configured to face and be adhered to both the outer surface of the second sticker 420 and the outer surface of the filter tip structure 4 when the third surface is winded, and the fourth surface is provided with a concave and convex type design and/or text which can increase the aesthetics.

Furthermore, the third sticker 430 is any one of tipping paper, art paper, plastic paper, and synthetic paper.

It will be understood by those skilled in the art that various changes may be made and equivalents may be substituted without departing from the scope of the present invention. But all the changes will be included within the scope of the appended claims.

What is claimed is:

1. A soft electronic cigarette, comprising an atomization component, a power component, and an outer sleeve configured for accommodating at least one of the atomization component and the power component; wherein, an outer side of one end of the outer sleeve is coaxially mounted with a filter tip structure, and the filter tip structure includes a cylindrical flexible body and a first sticker at least coated on an outer surface of the flexible body, and a second sticker at least coated an outer surface of the outer sleeve;

wherein, a flexible layer formed by soft rubber or filler is disposed between the outer sleeve and the second sticker;

wherein, the flexible body is a fiber filter cotton flexible body or a non-woven filter cotton flexible body;

wherein, the filler forming the flexible layer is at least one of carbon particle, plastic particle, glass particle, wooden particle, and metal particle, and is configured to simulate cut tobacco.

2. The soft electronic cigarette of claim 1, wherein, the atomization component is received in the outer sleeve, and an end surface of the flexible body and an end surface of the atomization component contact each other to form a radial coplanar structure.

3. The soft electronic cigarette of claim 1, wherein, the first sticker further envelops the outer sleeve.

4. The soft electronic cigarette of claim 1, wherein, an adhesive layer is formed on an inner surface of the first sticker.

5. The soft electronic cigarette of claim 1, wherein, the second sticker further envelops the first sticker.

6. The soft electronic cigarette of claim 5, wherein, the second sticker includes a first surface and a second surface that are opposite to each other, the first surface is a smooth surface configured to face and be adhered to both the outer surface of the outer sleeve and the outer surface of the filter tip structure when the second sticker is winded, and the second surface is provided with a concave and convex type design and/or text.

7. The soft electronic cigarette of claim 1, wherein, the first sticker and the second sticker partially overlap each other, and the first sticker is coated outside the second sticker.

8. The soft electronic cigarette of claim 1, wherein, an outer surface of the outer sleeve and an outer surface of the filter tip structure are coaxially coated with a third sticker, the third sticker is configured to fixedly connect the filter tip structure with the outer sleeve, and the second sticker is disposed between the outer sleeve and the third sticker.

9. The soft electronic cigarette of claim 8, wherein, the third sticker includes a third surface and a fourth surface that are opposite to each other, the third surface is a smooth surface configured to face and be adhered to both the outer surface of the second sticker and the outer surface of the filter tip structure when the third sticker is winded, and the fourth surface is provided with a concave and convex type design and/or text.

10. The soft electronic cigarette of claim 8, wherein, the third sticker is any one of tipping paper, art paper, plastic paper, and synthetic paper.

11. The soft electronic cigarette of claim 1, wherein, the first sticker is any one of tipping paper, art paper, plastic paper, and synthetic paper.

12. The soft electronic cigarette of claim 1, wherein, the second sticker is any one of tipping paper, art paper, plastic paper, and synthetic paper.

13. The soft electronic cigarette of claim 1, wherein, the flexible body is stuck to or fused with one end of the atomization component or one end of the power component.

* * * * *